US005118285A

United States Patent [19]

Le Monnier de Gouville et al.

[11] Patent Number: 5,118,285

[45] Date of Patent: Jun. 2, 1992

[54] COOKING APPARATUS EQUIPPED WITH AT LEAST ONE GAS INJECTOR AND AT LEAST ONE VENTURI FORMED AS A UNITARY PART AND A UNITARY PART FOR SUCH AN APPARATUS

[75] Inventors: Jean-Bernard Le Monnier de Gouville, Joue-les-Tours; André Moreau, Tours, both of France

[73] Assignee: Sourdillon, Veigne, France

[21] Appl. No.: 592,494

[22] Filed: Oct. 3, 1990

[30] Foreign Application Priority Data

Oct. 3, 1989 [FR] France ..... 89 12914

[51] Int. Cl.[5] ..... F24C 3/10

[52] U.S. Cl. ..... 431/191; 126/39 H; 431/193; 431/354

[58] Field of Search ..... 431/191, 192, 355, 193, 431/194, 354; 126/39 R, 39 H, 39 K

[56] References Cited

U.S. PATENT DOCUMENTS

| | | | |
|---|---|---|---|
| 2,930,433 | 3/1960 | Brodbeck et al. | 126/39 H |
| 3,219,098 | 11/1965 | Fulmer | 126/39 H |
| 3,938,945 | 2/1976 | Riehl | 431/191 |
| 4,428,726 | 1/1984 | Kimpara et al. | 431/355 |

*Primary Examiner*—Carroll B. Dority
*Attorney, Agent, or Firm*—Larson and Taylor

[57] ABSTRACT

A gas cooking apparatus is disclosed, particularly a cooking table, comprising at least one gas burner (1) including: a burner head (2) fixed sealingly on a top plate (3) of the apparatus, a gas injector (6) situated axially under the head of the burner and mounted on a support plate (10), and a diffuser tube (4) forming a venturi situated axially between the injector and the burner head and opening into the latter, characterized in that the plate (10) supporting the injector (6) and the venturi-forming tube (4) belong to the same unitary part (15) formed of a single metal sheet shaped by cutting out, bending and rolling.

13 Claims, 3 Drawing Sheets

COOKING APPARATUS EQUIPPED WITH AT LEAST ONE GAS INJECTOR AND AT LEAST ONE VENTURI FORMED AS A UNITARY PART AND A UNITARY PART FOR SUCH AN APPARATUS

The present invention relates to improvements to the structure of gas cooking apparatus such as cookers, stoves and cooking plates, which comprise at least one gas burner including:

- a burner head fixed sealingly on a top plate of the apparatus,
- a gas injector situated axially under the head of the burner and mounted on a support plate, and
- a diffuser tube forming a venturi situated axially between the injector and the burner head and opening into the latter.

In the usual structures of cooking apparatus, each component (injector, injector support, venturi, flame transfer duct, etc..) is manufactured separately and is then mounted on the structure of the cooking apparatus or directly on the burner head so as to form a finished assembly. Such independent and diversified manufacture requires specific production units equipped with appropriate tools: the different components may be manufactured by sub contractors, whence the need of transport as far as the assembly shop and storage of reserve parts; finally, the assembly is carried out by welding, screwing, bolting, clipping, etc., involving specific labour and not inconsiderable assembly times.

Generally, the method of manufacture and the present day positioning of certain components of cooking apparatus is costly in material, labour and time.

The purpose of the invention is then essentially to overcome these drawbacks and provide a technological solution which gives better satisfaction to the different requirements of practice, particularly in simplifying the manufacture of the components and simplifying the assembly thereof.

For this, a cooking apparatus of the above kind, adapted in accordance with the invention, is essentially characterized in that the plate supporting the injector and the venturi tube belong to the same unitary part comprising a single metal sheet formed by cutting out, bending and rolling.

Of course, the invention is more advantageous when it is a question of equipping a cooking apparatus having at least two burners: under these conditions, the two injectors are mounted on the same support plate and the support plate and the two venturi tubes belong to the same unitary part comprising a single metal sheet formed by cutting out, bending and rolling and extending between the two burners.

However, it will be understood that the invention is even more advantageous when the number of components is high, i.e. not only when the cooking apparatus has several (at least two) gas burners, but also when several components are associated with each burner. This is the case for the above mentioned cooking apparatus of the type with ignition by flame transfer from centralized ignition means, in which the two flame transfer tubes extend between the centralized ignition means and the respective burners; in this case, it advantageous, in accordance with the invention, for the plate for supporting the injectors, the two venturi tubes and the two flame transfer tubes to belong to the same unitary part comprising a single metal sheet formed by cutting out, bending and rolling and extending between the two burners.

In a first simple embodiment, which concerns all types of cooking apparatus, the unitary part includes at least one part having in cross section the general form of an L which comprises:

- a first substantially horizontal wing with an opening for the gas injector, and
- a second wing substantially perpendicular to the first wing and comprising
- an upper end portion situated substantially in line with said opening for the injector and connected to the second wing by a relatively narrow zone of material, this upper end portion being formed by a tongue of material cut out and rolled on itself substantially vertically and substantially coaxially with said opening so that a tubular truncated cone shaped section is defined with a small orifice situated at the bottom and with a substantially vertical axis forming a venturi.

In a second embodiment which concerns apparatus of the above kind having at least two burners, the preceding arrangement is completed by the fact that the unitary part is further of an elongate shape with a length corresponding approximately to the spacing between the two burners and the second wing of this unitary part comprises two upper end portions shaped as a venturi which are situated longitudinally at a distance from each other respectively under the two burner heads.

In a third embodiment which concerns apparatus with flame transfer ignition, the preceding arrangement is further completed by the fact that, between the two upper end portions, the second wing of the unitary part has two intermediate upper portions spaced longitudinally apart from each other and each formed by a tongue of material rolled on itself about a substantially horizontal axis so as to define a flame transfer duct.

In a fourth embodiment which concerns apparatus having at least two burners, the unitary part has the general shape of a U whose bottom and two legs define two L shaped parts with spacing corresponding substantially to the spacing between the two burners, the two upper end portions being shaped as venturis situated respectively under the two burner heads.

In a fifth embodiment which concerns apparatus with flame transfer ignition, the preceding arrangement is completed by the fact that the unitary part has the general shape of a U extending approximately under four burners, the two legs of the U being shaped so that each carries two venturis and possibly two flame transfer ducts.

Thus, with the arrangements chosen in accordance with the invention, all the components which are associated with the burner head or heads to form one or more gas burners equipping the cooking apparatus are associated in the form of a unitary part which is easy to position; only this unitary part and more particularly the part thereof forming a support for the injectors (which support is generally in the form of a flat plate portion), needs to be fixed to the structure of the apparatus; the components which are integral therewith and form an integral part thereof are then positioned automatically in the appropriate functional position.

Furthermore, the manufacture of such a unitary part is simplified to the extent that it is not a question of a sub-assembly obtained by previous assembly of individual components, but it is a question of a single part adapted to be manufactured from a metal sheet, a relatively inexpensive raw material and simple to store and provide. The operations for cutting out this metal sheet so as to obtain a blank to the desired pattern and contour, bending of this blank into an L or U shape and finally rolling of the portions intended to form the venturis and the flame transfer ducts are elementary metal sheet working operations, for carrying out which there exist high performance machines which are relatively less inexpensive than the machine tools required for manufacturing the individual components.

The cooking apparatus adapted in accordance with the invention incorporates then a unitary part which is economical as to the raw material used, economical to manufacture and economical to assemble.

The invention will be better understood from the following description of a preferred embodiment given solely by way of non limitative example. In this description, reference is made to the accompanying drawing.

Figure 3:
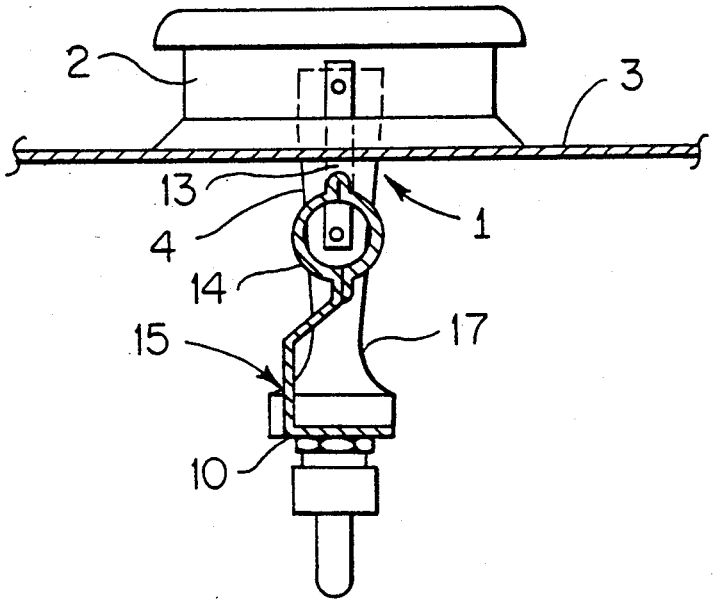
FIG. 3 is a sectional elevation view taken along the lines 3—3 of FIG. 1.
Figure 4A:
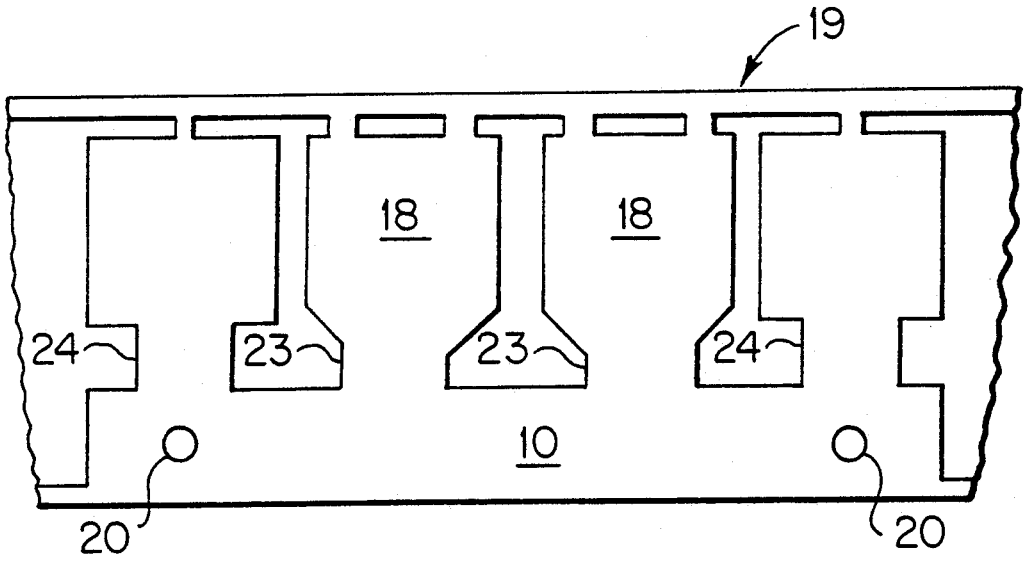
Figure 5:
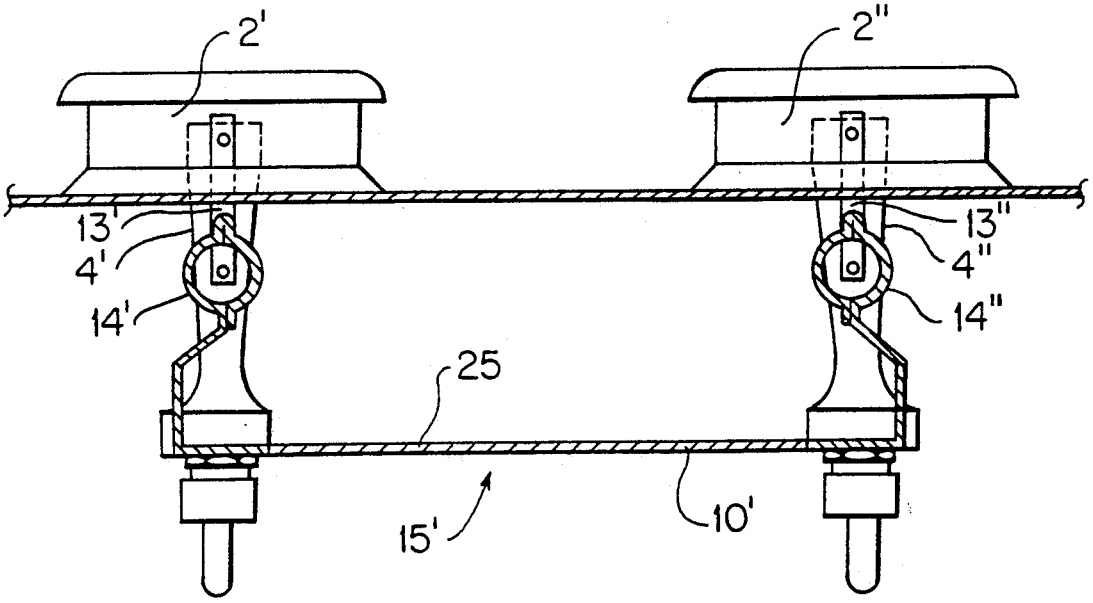

FIGS. 4A, B and C are schematic illustrations of the steps of cutting out, rolling and bending involved in fabricating a unitary part in accordance with the invention; and FIG. 5 is a sectional elevation view similar to FIG. 3 of a further embodiment in which the unitary part formed from a single metal sheet shaped by cutting out, bending and rolling in accordance with the invention extends under four burners.

The drawing shows a cooking apparatus equipped with several gas burners (in this case two), for it is essentially in this case, though not exclusively, that the invention seems to be the most advantageous.

The two burners, each designated as a whole by the reference 1, each comprise a burner head 2 mounted sealingly on a top plate 3. Under the burner head 2 and coaxially therewith there extends a vertical truncated cone shaped tube 4, with a small lower opening 5 opening above and at a distance from a gas injector 6 fixed, for example screwed, in an injector holder 7 with which a gas inlet tube 8 is connected. Tube 8 is connected, at its other end, to an individual regulation tap 9.

The truncated cone shaped tube 4 forms a diffuser or venturi accelerating the air-gas mixture fed into the burner head.

The injector 6 and the injector holder are fixed in the following way to a support plate 10, itself fixed to the structure of the apparatus in any appropriate way, not shown (screwing, bolting, clipping, etc. . . . ). Injector 6 is screwed on the injector holder which has a larger diameter than the injector, and the whole is fitted from underneath into an opening in the support plate 10. A clamp or clip 11 is fitted, from the top of plate 10, so as to cooperate with an external groove formed in the wall of injector 6.

Finally, in the case more specifically shown where the apparatus is of the type with ignition by flame transfer from centralized ignition means, an ignition member is provided disposed between the two burners 1 (shown schematically by a pilot flame 12 in FIG. 1); each burner 1 is equipped with a small vertical flame propagation tube 13; finally, between the centralized ignition means and the base of tube 13, there is situated a horizontal flame transfer duct 14.

According to the invention, the support plate 10, the venturis 4 and the flame transfer ducts 14 belong to one and the same unitary part, designated as a whole by the reference 15, which unit is obtained by stamping, bending and rolling a single metal sheet.

In the example shown, this unitary part 15 is of elongate shape and extends approximately between the two burners 1. Its cross section is substantially in the shape of an L, with a first horizontal wing which forms said support 10 at the ends of which openings are provided for fitting the injectors, a second vertical wing 16 is cut out so as to have several vertical lugs (in this case four in number). Two end lugs 17, situated respectively in line with the openings provided for the injectors in the first wing 10, have their upper end which is cut out so as to be attached only by a narrow zone of material and which is rolled on itself about a substantially vertical axis coinciding approximately with the axis of the opening in wing 10; cutting out of the edges of this portion of lug 17 and rolling same on itself are further carried out such that the tube 4 formed has the shape of a truncated cone with its small orifice situated at the bottom.

Similarly, between the two lugs 17 and spaced apart from each other on each side of a central zone, two lugs 18 are provided whose upper part is rolled on itself about a horizontal axis so as to form a horizontal cylindrical duct of revolution 14.

The cutting out, bending and rolling operations may be carried out with simple machines readily available in the workshops, from flat metal sheets.

Figure 1:
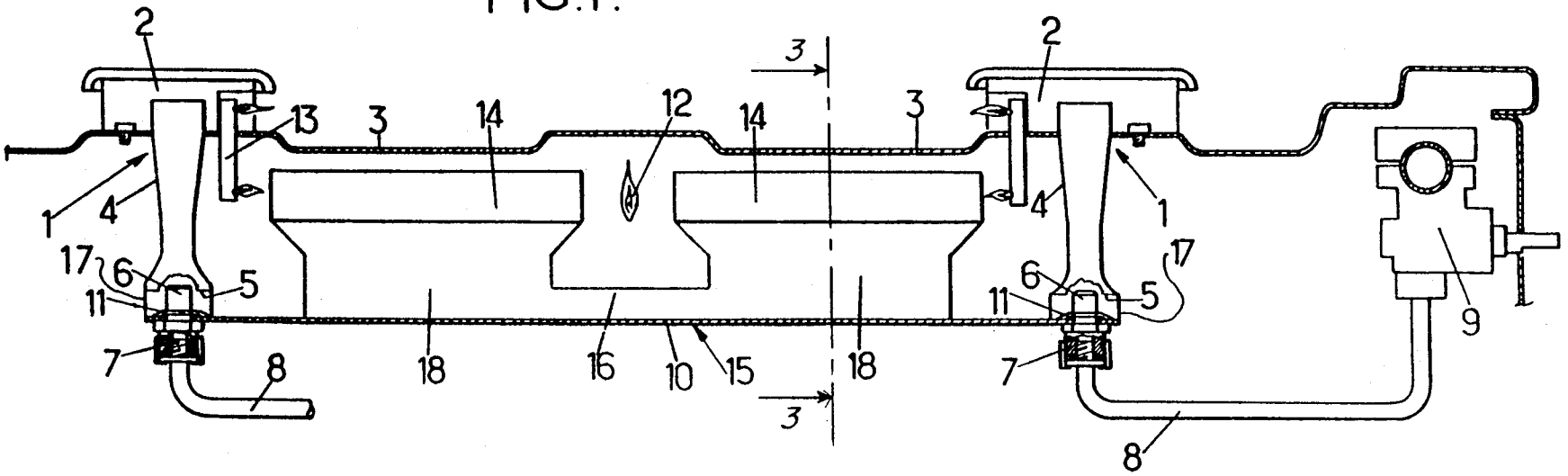
FIG. 1 is a side elevation view, partially in section, of a part of a gas cooking apparatus provided with a unitary part formed from a single metal sheet shaped by cutting out, bending and rolling in accordance with the invention.
Figure 2:
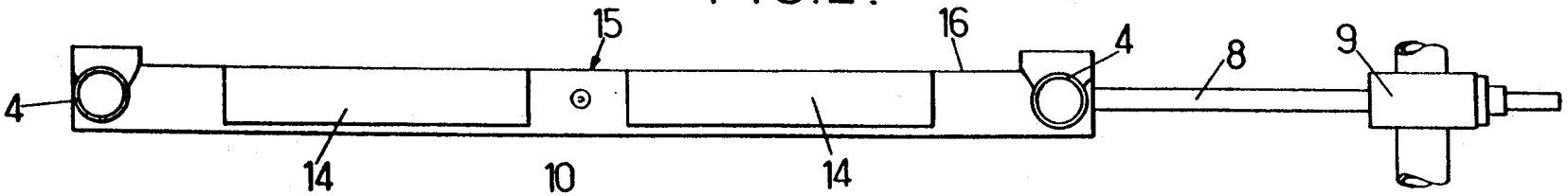
FIG. 2 is a top view of the unitary part of the gas cooking apparatus of FIG. 1.
Figure 4B:
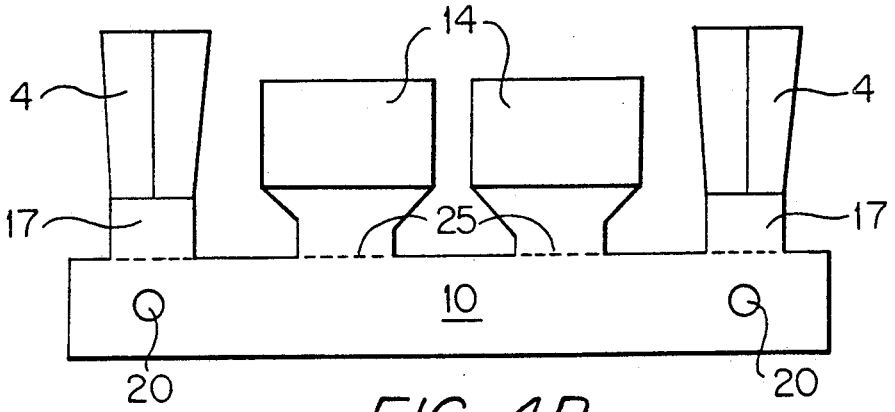
Figure 4C:
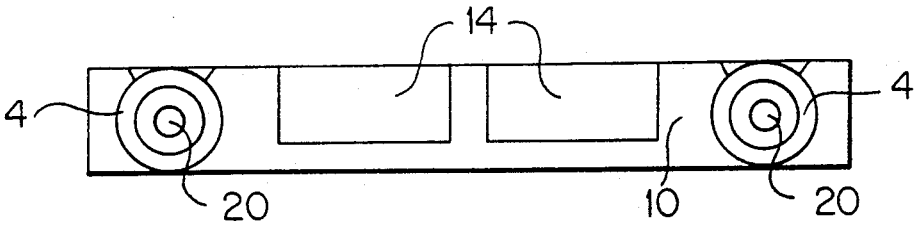

FIG. 4A is a schematic illustration of the cutting out of a flat metal sheet 19. The sheet is cut as shown to provide shapes for formation of the members shown in FIGS. 1–3. Thus, two central lugs 18 and two outer lugs 17 are joined to the sheet by narrow zones of material 23, 24. The lower part of the sheet, which becomes horizontal wing 10, is provided with holes 20 for the fitting of injectors 6. FIG. 4B is a schematic illustration of the rolling of lugs 17 and 18 to form, respectively, venturis 4 and transfer ducts 14. The lower part of the sheet is then bent along line 25 to form horizontal wing 10, thus completing fabrication of an L shaped unitary part as illustrated in FIGS. 1–3.

Of course, the arrangement which has just been described is open to numerous variants and adaptations depending on the type of cooking apparatus to be produced.

Although an L shaped unitary part combining the injector support and the venturi of a single burner may be formed in an elementary way, the advantages of the arrangements used in accordance with the invention are particularly positive if the L shaped unitary part combines the injector support and the venturis of several (at least two) aligned burners. These advantages will of course be more appreciable if the number of component members grouped together on the L shaped unitary part is high: this advantage is obtained in the case of an apparatus comprising several burners aligned with centralized ignition means, the L shaped unitary part then combining the support for the injectors, the venturis with vertical axis and the flame transfer ducts with horizontal axis.

A cooking apparatus having a number of burners greater than two (for example four burners situated at the apices of a quadrilateral) may be equipped by providing several L shaped unitary parts.

However, the design of an L shaped unitary part is not the only construction possible, and in the case of several (at least two) burners, the U shaped unitary part may be adapted so that, in practice, it is capable of fulfilling the functions of two parallel L shaped unitary parts: in the case of two burners, the bottom part forms the support for the injectors and the two legs of the U form the lugs from which the two venturis are formed respectively. Similarly, in the general case of an apparatus with four burners, the U shaped unitary part may be made sufficiently long to extend under the four burners and be shaped for supporting the four injectors and incorporating all the venturis and all the flame transfer ducts. This is illustrated in FIG. 5 which shows two burners 2', 2'' of the four burners of a four burner unit. The unitary part 15' in this case is U shaped and is fabricated from a single sheet of metal 10' which has a portion 25 which is sufficiently long to extend under the four burners and shaped to receive four injectors and to incorporate all of the venturis and transfer ducts, two venturis 4', 4'' and two transfer ducts 14', 14'' being shown. The four burner apparatus may then be equipped by positioning a single unitary part.

Of course, other arrangements are possible depending on the particular structures of the apparatus to be manufactured; in particular, combinations of L shaped zones and U shaped zones may be provided in the same unitary part.

As is evident, and as it follows already from what has gone before, the invention is not limited to those of its modes of application and embodiments which have been more particularly envisaged; it embraces, on the contrary, all variants thereof.

We claim:

1. Gas cooking apparatus comprising at least one gas burner including:

a burner head fixed sealingly on a top plate of the apparatus, a gas injector situated axially under the head of the burner and mounted on a support plate, and a diffuser tube forming a venturi situated axially between the injector and the burner head and opening into the latter, characterized in that the plate supporting the injector and the venturi-forming tube belong to the same unitary part formed of a single metal sheet shaped by cutting out, bending and rolling.

2. Cooking apparatus according to claim 1, having at least two burners, characterized in that two injectors are mounted on the same support plate and in that the support plate and two venturi tubes belong to the same unitary part formed from a single metal sheet shaped by cutting out, bending and rolling, and extending between the two burners.

3. Cooking apparatus according to claim 2, with central ignition means for igniting each gas burner by flame transfer, two flames transfer tubes extending between the central ignition means and the respective burners, characterized in that the plate supporting the injectors, the two venturi tubes and two flame transfer tubes belong to the same unitary part formed of a single metal sheet shaped by cutting out, bending, and rolling, said unitary part extending between the two burners.

4. Cooking apparatus according to claim 1, characterized in that the unitary part includes at least one part having in cross section the general form of an L which comprises:

a first substantially horizontal wing with an opening for the gas injector, and a second wing substantially perpendicular to the first wing and comprising an upper end portion situated substantially in line with said opening for the injector and connected to the second wing by a relatively narrow zone of material, this upper end portion being formed by a tongue of material cut out and rolled on itself substantially vertically and substantially coaxially with said opening so that a tubular truncated cone shaped section is defined with a small orifice situated at the bottom and with a substantially vertical axis forming a venturi.

5. Cooking apparatus according to claim 4, characterized in that the unitary part is of an elongate shape with a length corresponding approximately to the spacing between the two burners and in that the second wing of said unitary part comprises two upper end portions shaped as a venturi which are situated longitudinally at a distance from each other respectively under the two burner heads.

6. Cooking apparatus according to claim 5, characterized in that, between the two upper end portions, the second wing of the unitary part has two intermediate upper portions spaced longitudinally apart from each other and each formed by a tongue of material rolled on itself about a substantially horizontal axis so as to define a flame transfer duct.

7. Cooking apparatus according to claim 4, characterized in that the unitary part has the general shape of a U whose bottom and two legs define two L shaped parts with spacing corresponding substantially to the spacing between the two burners, the two upper end portions being shaped as venturis situated respectively under the two burner heads.

8. Cooking apparatus according to claim 7, characterized in that the unitary part has the general shape of a U extending approximately under four burner heads, the two legs of the U being shaped so that each carries two venturis.

9. Component part intended to be fitted in a gas cooking apparatus comprising at least one gas burner, characterized in that it is formed from a single metal sheet shaped by cutting out, bending and rolling and in that it comprises at least one portion having in cross section the general form of an L which comprises:

a first substantially horizontal wing with an opening for a gas injector, and a second wing substantially perpendicular to the first wing and comprising an upper end portion situated substantially in line with said opening for the injector and connected to the second wing by a relatively narrow zone of material, said upper end portion being formed by a tongue of material cut out and rolled on itself about an axis coinciding substantially with the axis of said opening so that a tubular truncated cone shaped section is defined with its axis substantially perpendicular to the first wing and with a small orifice situated in the lower part, forming a venturi for the burner.

10. Component part according to claim 9, characterized in that it is of an elongate shape with a length corresponding approximately to the spacing between two burners of the cooking apparatus which it is intended to equip and in that its second wing comprises two upper end portions formed as a venturi which are situated longitudinally at a distance from each other.

11. Component part according to claim 10, characterized in that, between the two upper end portions, the second wing has two intermediate upper portions spaced longitudinally apart from each other and each formed by a tongue of material rolled on itself about an axis substantially parallel to the first wing so as to define a cylindrical duct of revolution for forming a flame transfer duct.

12. Component part according to claim 9, characterized in that it has the general shape of a U whose bottom and two legs define two L shaped parts with spacing corresponding substantially to the spacing between two burners of the cooking apparatus which it is intended to equip, the two upper end portions being shaped as truncated cone shaped tubular sections each having an axis perpendicular to the bottom of the U and forming venturis respectively for the two burners.

13. Component part according to claim 12, characterized in that it has the general shape of a U dimensioned so as to extend approximately under four burners of the cooking apparatus which it is intended to equip, the two legs of the U being shaped so that each carries two truncated cone shaped tubular sections with axes perpendicular to the bottom of the U and forming venturis.

* * * * *